US009021650B2

(12) United States Patent
Lew

(10) Patent No.: US 9,021,650 B2
(45) Date of Patent: May 5, 2015

(54) LINT AND FUZZ BALLS REMOVER

(71) Applicant: Chester S. Lew, San Mateo, CA (US)

(72) Inventor: Chester S. Lew, San Mateo, CA (US)

( * ) Notice: Subject to any disclaimer, the term of this patent is extended or adjusted under 35 U.S.C. 154(b) by 0 days.

(21) Appl. No.: 14/301,260

(22) Filed: Jun. 10, 2014

(65) Prior Publication Data

US 2014/0289982 A1 Oct. 2, 2014

Related U.S. Application Data

(63) Continuation of application No. 13/159,331, filed on Jun. 13, 2011, now Pat. No. 8,776,301.

(51) Int. Cl.

| | |
|---|---|
| ***A47L 25/08*** | (2006.01) |
| ***A47L 25/00*** | (2006.01) |
| ***A46D 1/00*** | (2006.01) |

(52) U.S. Cl.

CPC ..... *A47L 25/00* (2013.01); *A46D 1/0292* (2013.01); *A46B 2200/3053* (2013.01)

(58) Field of Classification Search

USPC ..... 15/104.001, 104.002, 210.1, 160

See application file for complete search history.

(56) References Cited

U.S. PATENT DOCUMENTS

| | | | |
|---|---|---|---|
| 2,934,810 | A | 5/1960 | Kanbar |
| 3,363,276 | A | 1/1968 | Thomas |
| 3,471,977 | A | 10/1969 | Roth |
| 4,639,965 | A | 2/1987 | Suzuki |
| 4,686,731 | A | 8/1987 | Suzuki |
| 4,687,095 | A | 8/1987 | Iwasaki |
| 5,036,561 | A | 8/1991 | Calafut |
| D389,619 | S | 1/1998 | McLeod |
| 6,260,228 | B1 | 7/2001 | Arroyo-Youngblood |
| 6,298,514 | B1 | 10/2001 | Lazich et al. |
| 6,901,622 | B2 | 6/2005 | Thompson et al. |
| 2003/0044569 | A1 | 3/2003 | Kacher et al. |
| 2006/0225233 | A1 | 10/2006 | McKay |
| 2011/0258790 | A1 | 10/2011 | Cole |

*Primary Examiner* — Shay Karls

(74) *Attorney, Agent, or Firm* — Intellectual Property Law Group LLP

(57) ABSTRACT

A lint and fuzz ball removing device is disclosed comprising at least one blade attached to an easily grasped and maneuvered body allowing for the quick removal and or detangling of lint, hair and pill balls. The blade surface is entirely covered with particle removing hooks or finger-like projections, including a plurality of flat surfaces, and edges of the blade, allowing for the quick and easy removal of lint, hair, fuzz and pill balls of any shape and size, across broad surfaces or hard to reach areas of clothing and fabric.

20 Claims, 5 Drawing Sheets

LINT AND FUZZ BALLS REMOVER

CROSS-REFERENCE TO RELATED APPLICATIONS

This application is a continuation of non-provisional application Ser. No. 13/159,331 filed on Jun. 13, 2011, which is incorporated herein by reference.

BACKGROUND

1. Field of Invention

The present invention relates to a manual apparatus for effectively removing lint and fuzz balls on surfaces. More specifically, the present invention relates to a hand-held portable apparatus that detangles pill balls and removes fuzz from knit fabric.

2. Background

The process known as "pilling" occurs when fabrics rub against another surface, causing fibers to naturally migrate to the surface of the fabric. Further rubbing causes fibers to collect in the form of balls, fuzz or pill balls, on the surface of the fabric. The level of pilling depends on the fabric type. Natural and synthetic fibers form pills making new fabric look unattractive and old, pilling can also create holes in fabric.

Devices for dealing with lint and fuzz balls such as brushes, volcano bricks, coarse sand combs, electric fabric shavers, lint rollers and sweater combs do not effectively and quickly remove pill balls and lint. Brushes can only remove loose lint, hair and straighten fibers, and when used improperly, can damage the fabric. Volcano bricks and coarse sand combs remove fuzz balls with gentle abrasion but leave residue from crumbs that easily break off. These devices only brush the lint. Electric fabric shavers only remove pill balls that fit into the holes of the shavers before they are cut and cannot remove any hair from the fabric. Electric fabric shavers require an electrical supply and are limited in the areas of use because they cannot remove lint and fuzz balls in tight areas. Lint rollers superficially remove lint on the outer surface of fabric, not pill balls that are intertwined with threads of the fabric. Sweater combs use abrasive particulates to cut certain pill balls that are pushed into a waffle shaped mesh.

Accordingly, there is a need for a lint and fuzz ball removing device that brushes out and removes lint, hairs and different size and shaped pill balls from all types of knit fabric. There is more specifically, a need for device that is capable of removing these unwanted particles from hard to reach areas without damaging or leaving residue on fabric.

SUMMARY

The apparatus in accordance with an embodiment of this invention is a depilling device, that serves as a device for removing both lint and pill balls from knit fabric, such as wool or cashmere. The device effectively depills all types of knit garments, including sweaters, coats and blankets. The device utilizes a blade comprising particle removing projections and a flat body that is both flexible and stiff in structure to brush out and remove unwanted particles. An embodiment of the present invention comprises two blades, positioned on opposite ends of the body. In this embodiment, one blade is longer than other, providing greater coverage for removing pill balls on larger surface areas. In another embodiment, the blades are removably attached to the body.

There is disclosed a body of the device that is flexible yet stiff enough such that the device is easily grasped and maneuvered to remove lint and pill balls from fabric in all possible directions. The body provides a structural framework for maneuvering the blades over clothing or fabric. The blades of the device are comprised of particle removing projections, shapes ranging from "Y" shaped fine hooks to finger-like projections. The "Y" shaped hooks allow the device to remove particles from clothing or fabric made from thicker fiber threads. The finger-like projections allow the device to remove particles from thinner or finer fiber material.

An object of the inventive concept discloses particle removing projections or "Y" shaped hooks that cover the entire blade of the device, including each surface, edge and pointed edge. The particle removing projections or hooks on the blade's edges, and particularly the pointed edges, allow for easy and quick removal of lint, hairs and pill balls from tight or hard to reach areas that might otherwise remain covered with fuzz or pilling.

There is disclosed a device for removing lint, hair and pills from fabric comprising a body comprising a first surface, a second surface, a first terminal edge and a second terminal edge, wherein the body is made of stiff yet flexible material, to flex under pressure and return to an original form after pressure is released. The device comprises at least one blade comprising a surface of a plurality of particle removing projections, the blade attached to the first surface of the body beginning from a distance away from the first terminal edge of the body and runs entirely along a length of the first surface, wrapped around the first terminal edge and ending on the second surface of the body, the blade further comprising a first side edge, a second side edge, and a pointed edge. The plurality of particle removing projections cover said blade, including the first side edge and second side edge, and the pointed edge and brushing the blade across a surface of a fabric removes or brushes out unwanted lint, hair or pills.

There is further disclosed a device for removing lint, hair and pills from fabric comprising a body having a flat structure comprising a first terminal edge and a second terminal edge, a side edge and a pointed corner, wherein said body is made of stiff yet flexible material, where at least one blade comprising an outer surface of particle removing material, the blade being attached to a first side of the body from the first terminal edge to a first distance inward on the first side of the body and crossing to a second side of the body to a second distance inward on the second side of the body, such that the blade runs along a longitudinal length of the first terminal edge and the particle removing material covers the first terminal edge, the side edge and the pointed corner, and wherein brushing the blade across the surface of a fabric removes or brushes out unwanted lint, hair or pill balls.

There is further disclosed a device for removing lint, hair and pills from fabric comprising a body having a flat shape, a first side edge and a second side edge, a first blade and a second blade, the first blade further comprising a first pointed edge and the second blade further comprising a second pointed edge, wherein the first blade is attached to and runs along a length of the first side edge, and the second blade is attached to and runs along a length of the second side edge, said first blade covered with particle removing projections such that contacting the first blade across a surface of the fabric removes or detangles unwanted lint, hair or pill balls.

These and other aspects of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings.

These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

In the present invention, a lint and fuzz ball removing device is used to easily, quickly and effectively remove lint and pilling from clothing or fabric. This device utilizes a particle removing material, such as a fine hook material, to brush and remove hair, lint, large and small pill balls.

Figure 1:
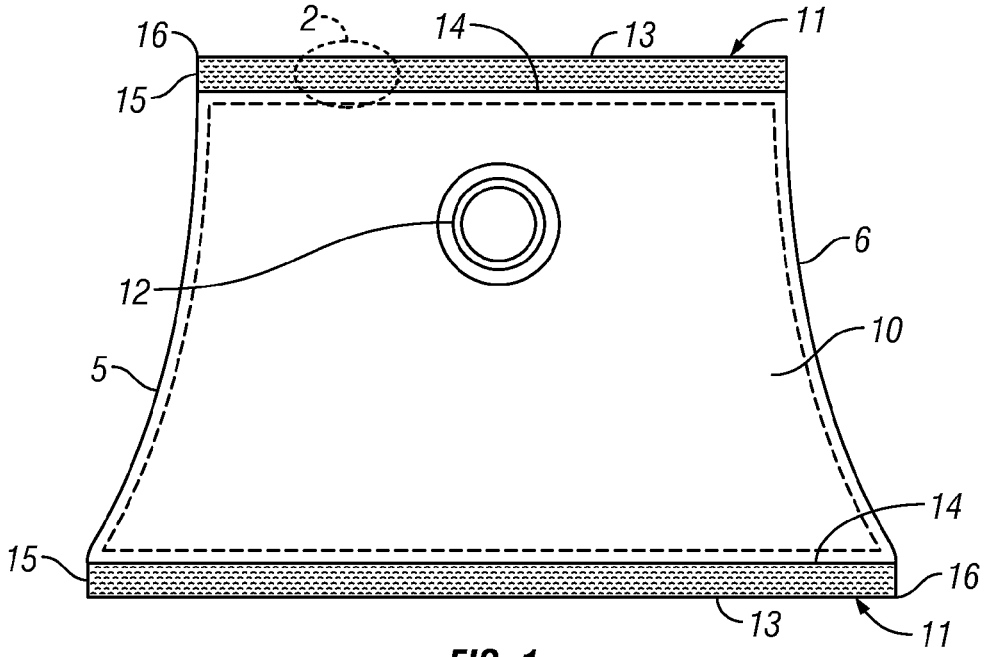
FIG. 1 is a front view of a lint and fuzz ball removing device, according to an embodiment of the present invention.
Figure 2:
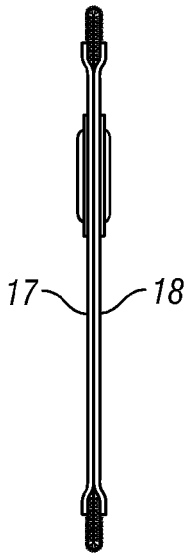
FIG. 2 is a side view of a lint and fuzz ball removing device of FIG. 1 in accordance with an embodiment of the present invention FIG. 3. is a front perspective view of a lint and fuzz ball removing device of FIG. 1, in accordance to an embodiment of the present invention.
Figure 3:
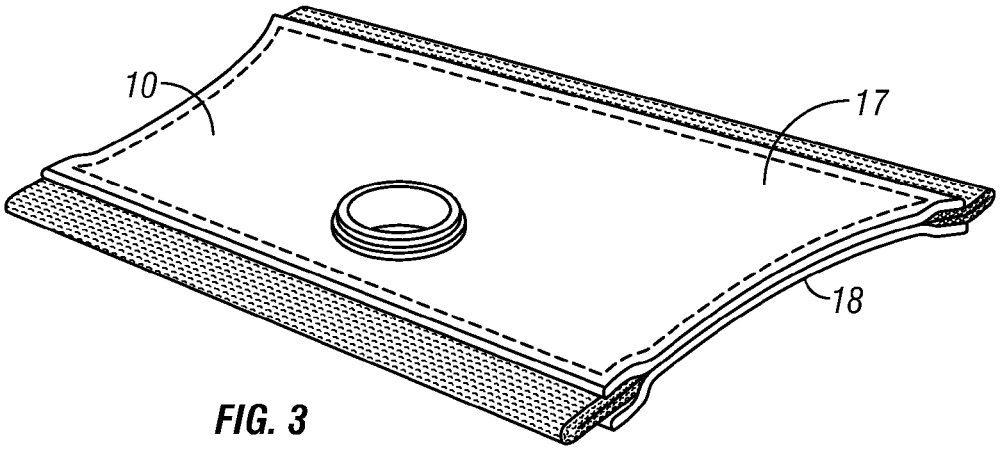

Referring to FIGS. 1, 2 and 3, an embodiment of the lint and fuzz removing device is comprised of a body 10 and at least one combing surface or blade 11. In a preferred embodiment of the invention, as shown in FIG. 1, the body 10 resembles a flat paddle-like form, serving as the handle of the device, that is easily and comfortably held in the hand. The body 10 is comprised of a stiff but flexible material. In an embodiment of the invention, the body 10 is constructed from polyvinylchloride (PVC) sheets that are sewn in place and sandwiched between thin leather fabrics. Other polymer, plastic or like material as known in the art may also be used. Alternatively, the PVC and leather fabric of the body 10 may be bound together by adhesive or any other binding methods known in the art. The body 10 provides the framework for providing structure, attaching or receiving a blade 11.

In another embodiment of the present invention, the device comprises of two blades 11, one blade 11 is positioned on the top side of the body 10 (first terminal edge) and the other 11 on bottom side (second terminal edge) as illustrated in FIG. 1. According to this embodiment, each blade 11 is thin, relatively flat and made to be flexible in construction. Each blade runs along the entire length of the body 10 from one side 5 of the body to another side 6, and consists of a terminal edge 13, an affixed edge 14, two side edges 15, two pointed edges 16, as illustrated in FIG. 1, and two handheld surfaces 17, 18 as illustrated in FIGS. 2 and 3. The affixed edge 14 is located at a distance away from the terminal edge 13. The thin and flat construction of the blade provides the device with a narrow contact surface which removes lint and fuzz balls with minimal drag. Such a construction also allows for quick picking capability for areas on the garment/fabric that are difficult to access, for example where areas of the fabric meet or overlap such as under the sleeve arms. Each blade 11 is connected to the body 10 from an affixed edge 14. In an embodiment of the invention, the top side of the body 10 is shorter than the bottom side, as shown in FIGS. 1 and 3.

In an embodiment of the invention, the blade 11 is constructed from a PVC sheet that is covered with a PVC material comprising particle removing projections such as fine injection hooks 20. In other embodiments, particle removing material can be made with rubber, a rubber coated material, or the like, as to form a blade with a soft combing surface of particle removing projections. In all embodiments, the particle removing projections on the blade may be handled and contacted to the skin of the user safely, having a bristly texture to a soft comb-like texture when touched.

Figure 4:
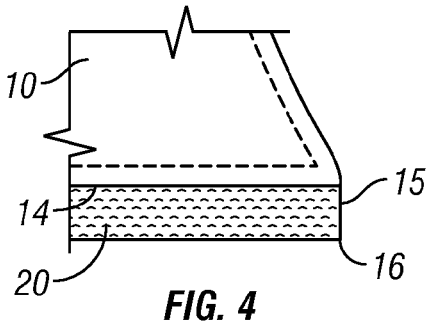
FIG. 4 is an enlarged fragmented front view of a lint and fuzz ball removing device of FIG. 1, in accordance to an embodiment of the present invention.
Figure 5:
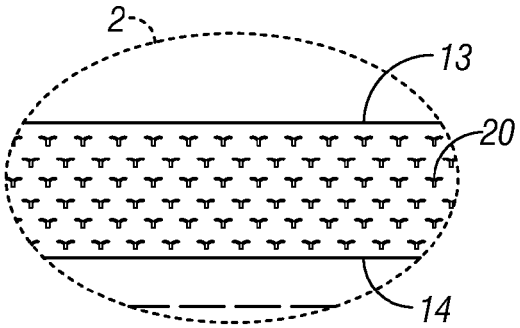
FIG. 5 is an enlarged view of a particle removing material of the circled portion designated 2 in FIG. 1.
Figure 6A:
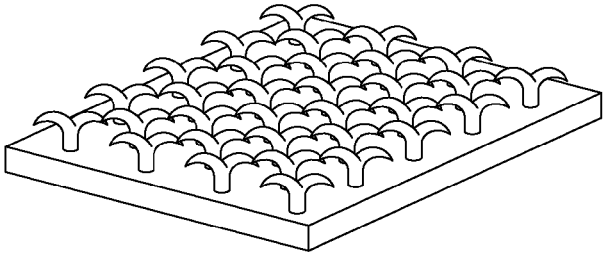
FIG. 6A is the enlarged view of a particle removing material of the circled portion designated 2 in FIG. 1, according to embodiment of the present invention.
Figure 6B:
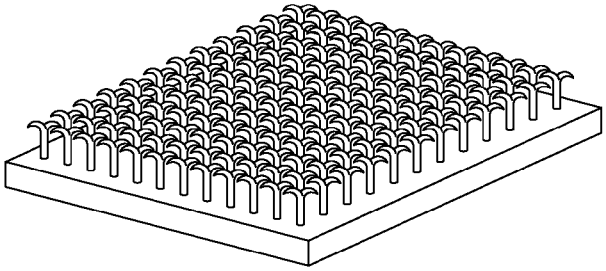
FIG. 6B is the enlarged view of a particle removing material, according to another embodiment of the present invention.

In one embodiment, the injection hooks are fine hook projections 20 spaced apart and shaped in a "Y" configuration as illustrated in FIG. 5 which illustrates the enlarged detail-2 as identified in FIG. 1. These hooks 20 are shaped in a "Y" configuration and cover all the blade surfaces and edges 13, 15, 16 of the blade 11, as shown in FIG. 4. In an embodiment, the "Y" configuration of hooks may more particularly be described with a projection that splits into two curling (hook-like) opposing ends as shown in FIG. 6A. The blade 11 has a thin construction such that the terminal edge 13, side edges 15 and pointed edges 16 of the blade have minimal contact and drag on the fabric. As the blade 11 is brushed over fabric to remove lint, hair or pill balls, unwanted and tangled fibers are combed through the "Y" shaped hook projections 20, where they are pulled, straighten, combed out and/or removed from the fabric. According to an embodiment, the hooks have a density of approximately 120 hooks per square centimeter of surface area. In another embodiment, the hook projections are more densely provided and having a finer grade and roughness as shown in FIG. 6B. In this embodiment, the material has a density of approximately 225 hooks per square centimeter of surface area.

Figure 6C:
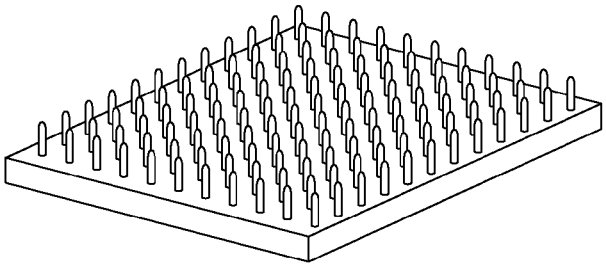
FIG. 6C is the enlarged view of finger-like projects of a particle removing material, according to another embodiment of the present invention.

In another embodiment, the particle removing material of the blade 11 comprises finger-like projections, or "I" shaped needle projections, as shown in FIG. 6C, that grab unwanted particles from the surface of fabric. In an embodiment, the finger-like projections are made from a soft rubber which may be softer than the "Y" shaped projections. The softer finger-like projections are used for removing lint and pill balls from more delicate or fine fabrics. According to an embodiment, the projections have a density of approximately 121 per square centimeter of surface area.

According to an embodiment of the invention, the pointed edge 16 of the blade 11 is formed from the meeting of the terminal edge 13 and the side edge 15, as shown in FIG. 4. The pointed edge 16 of the blade 11 is covered with particle removing projections such as the "Y" shaped hooks, as shown in FIGS. 1 and 4, and provide for the precise picking, combing/brushing and removal of unwanted lint, hair or pill balls in hard to reach areas.

In one embodiment, the lint and fuzz removing device comprises a single blade 11. In another embodiment, the device has two blades 11, each utilizing a different grade in type of particle removing material, or both a "Y" projection material type and a finger-like projection material type. Alternatively, each blade may be used for a different purpose.

Figure 7:
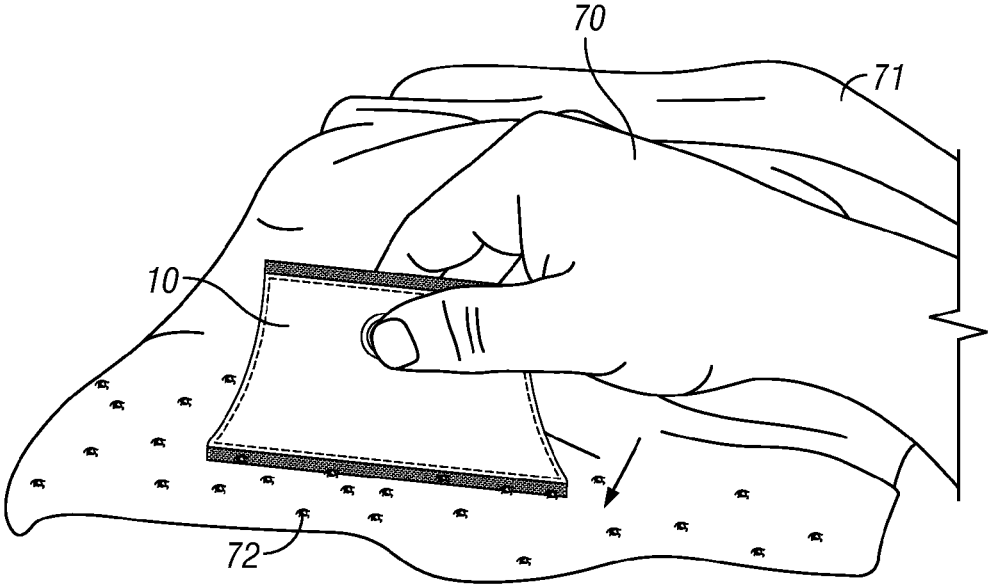
FIG. 7 is a pictorial view of a lint and fuzz ball removing device of FIG. 1 illustrating its operation in accordance to an embodiment of the present invention.

The method of use of the present invention involves grasping the body 10 of the device with the hand and fingers. The blade 11 is then used to maneuver to brush the surface of a fabric. The device can be stroked in various directions. In an embodiment of the present invention, the hand 70 grasps the device as illustrated in FIG. 7. The device is used in a stroking motion, allowing the particle removing material of the blade 11 to easily and effectively brush, detangle and remove large and small pill balls, hairs, lint and other unwanted particles 72 from fabric 71, as illustrated in FIG. 7.

Figure 8:
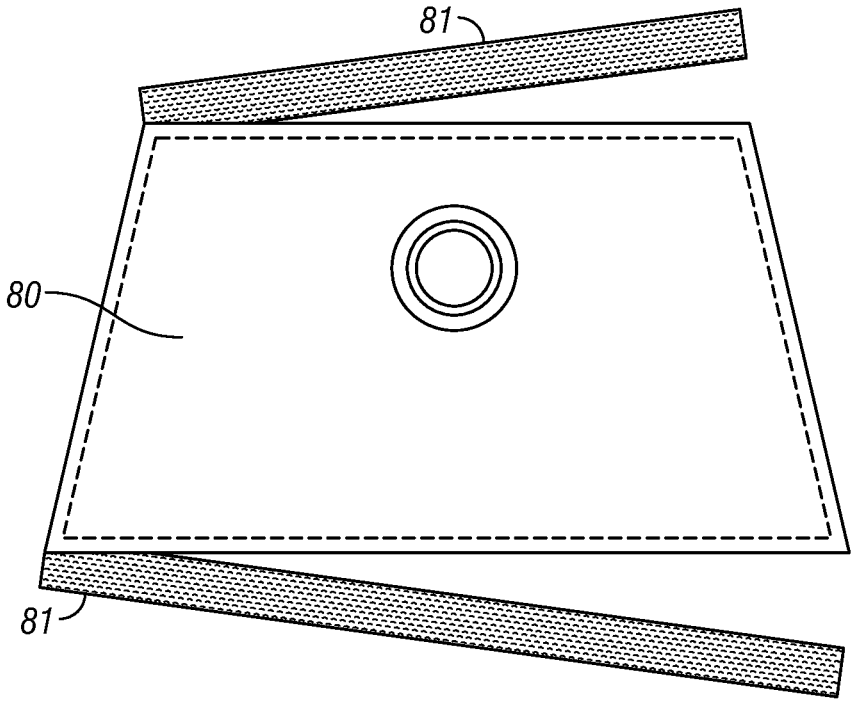
FIG. 8 is a front view of a lint and fuzz ball removing device, according to an embodiment of the present invention.

In another embodiment of the invention, the blade 81 of the device is attached to the body 80 such that the blade 81 can be folded into the body 80 like a switchblade as illustrated in FIG. 8. The blade 81 may be attached to the body 80 via hinged or pivoting connection points.

Figure 9A:
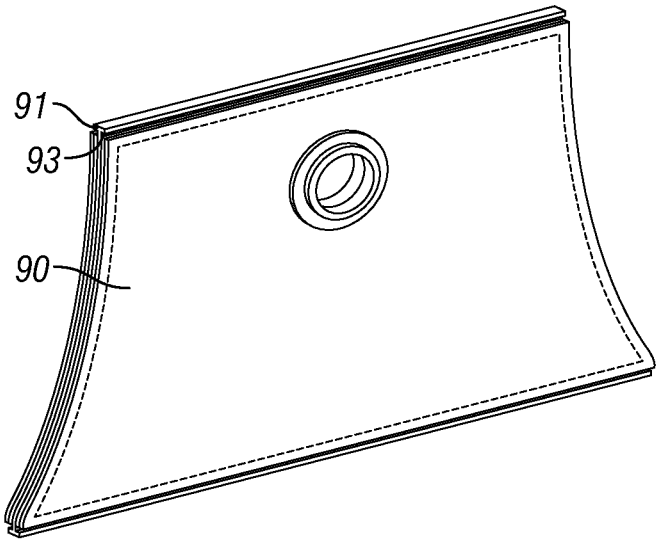
FIG. 9A is a perspective view of a body of a lint and fuzz ball removing device, according to another embodiment of the present invention.
Figure 9B:
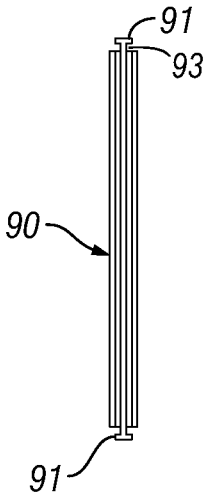
FIG. 9B is a cross-sectional side view of the device of FIG. 9A in accordance with an embodiment of the present invention.
Figure 9C:
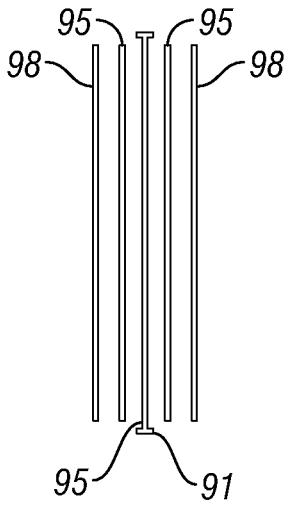
FIG. 9C is an exploded view of the device of FIG. 9A in accordance with an embodiment of the present invention.
Figure 10A:
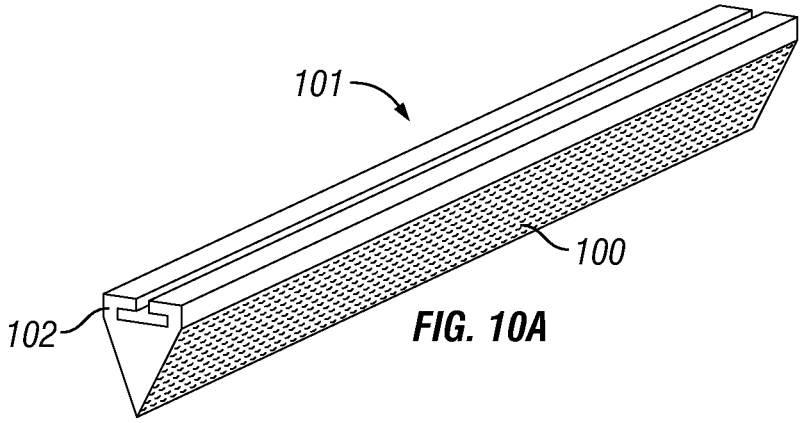
FIG. 10A is a perspective view of a blade for a lint and fuzz ball removing device, according to another embodiment of the present invention.
Figure 10B:
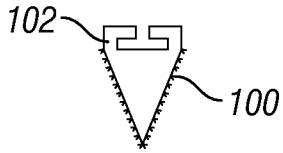
FIG. 10B is a side view of the blade of FIG. 10A in accordance with an embodiment of the present invention.
Figure 10C:
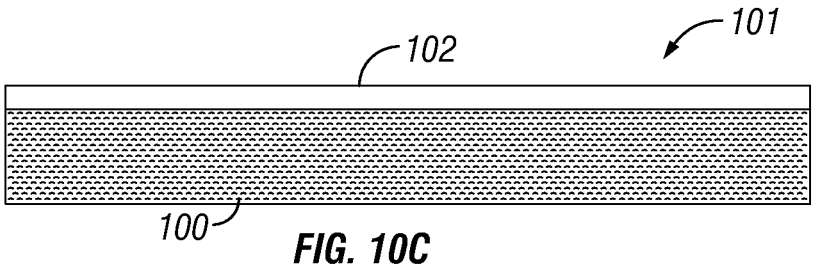
FIG. 10C is a front view of the blade of FIG. 10A in accordance with an embodiment of the present invention.

In another embodiment of the invention, the blades of the device are removable and changeable. In this embodiment, the device comprises a track 91 that runs along the outer edge of a side of the body 90 as illustrated in FIGS. 9A and 9B. The surfaces of the body 90 of the device comprise a leather layer 98 positioned adjacent to a PVC layer 95. In an embodiment of the invention as illustrated in FIG. 9C, a surface of the body 95/98 sandwiches the middle track layer 95 which also comprises a PVC, between a second surface of the body 95/98. A gap 93 between the track 91 and the body 90 provides a secure fit for the holding portion 102 of a removable blade 101. The track 91 extends from the edge of the body 90 by molded plastic (PVC) connection. A removable blade 101, illustrated in the enlarged views of FIGS. 10A, 10B and 10C, is removably attached to the body 90 by sliding the holding portion 102 of the blade 101 onto the track 91. The holding portion 102 is slid to fit closely onto the track 91, such that the blade 101 is held securely in place. In an embodiment of the invention, the blade 101 of the device can be replaced with a blade comprising a different grade of particle removing material 100. For example, a blade with fine "Y" shaped hooks can be removed and replaced with a blade with larger "Y" shaped hooks or softer finger-like projections.

In another embodiment, the body of the device comprises one affixed edge where that side may receive removeable and changeable blades. In this embodiment, the blade portion of the device may receive for interchange, two are more blades, each blade comprising a type of particle removing material. For example, the single bladed device comprises a blade portion that is removeable and changeable. The device is capable of being fitted with three different changeable blades, each blade comprising a different grade of particle removing material.

In another embodiment of the invention, as shown in FIG. 10A the particle removing material 100 is attached the edges of the blade 101 such as by glue attachment. The material 100 is cut to fit the shape of the triangular surface area of the blade, glued and folded to wrap around the blade edge. More specifically, in another example, a strip of injection hook material shaped in a small long cut, is glued to the two side edges 15 to form the sharp terminal edge 13 of the blade.

According to another embodiment the blades comprise removable flexible sheet material with "Y" shaped hooks or projections on an outer facing side, to attach to the edges of the body by wrapping around each edge. The blade sheet material adhering to the body by fastening means or by hook-and-loop attachment on an underside of the sheet against the contact surface of the body edge.

In another embodiment, the device comprises two blades, each of a different grade or kind of particle removing material such that each blade is used for a different purpose. In another embodiment of the invention, the body 10 of the device comprises an aperture or hole 12, as shown in FIG. 1, which provides a method for hanging and storage of the device.

In a further embodiment of the present invention, the body is made into an ergonomic handle to conform comfortably to the hand, while still providing the necessary grip, flexibility and interchangeability in brushing direction.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

I claim:

1. A device for removing lint, hair and pills from fabric comprising:

a body comprising a first terminal edge and a second terminal edge, a first surface spanning from the first terminal edge to the second terminal edge, and a second surface spanning from the first terminal edge to the second terminal edge, the first surface facing an opposite direction than the second surface, and the entire first surface being substantially parallel to the entire second surface, wherein said body is made of stiff yet flexible material, to flex under pressure and return to an original form after pressure is released;

at least one blade comprising a surface of a plurality of particle removing projections, the blade attached to the first surface of the body beginning from a distance away from the first terminal edge of the body and runs along a length of the first surface, wrapped around the first terminal edge and ending on the second surface of the body, the blade further comprising a first side edge, a second side edge, a first pointed corner at the meeting of the first side edge and the first terminal edge, and a second pointed corner at the meeting of the second side edge and the first terminal edge;

wherein the plurality of particle removing projections cover said blade, including the first side edge and second side edge, the first pointed corner and the second pointed corner;

wherein brushing the blade across a surface of a fabric removes or brushes out unwanted lint, hair or pills.

2. The device of claim 1, wherein the plurality of particle removing projections are evenly spaced finger-like projections.

3. The device of claim 1, wherein particle removing projections are evenly spaced Y shaped fine hooks.

4. The device of claim 1, further comprising a second blade attached around the second terminal edge of the body.

5. The device of claim 4, wherein the second terminal edge of the body is parallel and shorter in length than the first terminal edge.

6. The device of claim 4, wherein the second blade further comprises particle removing projections shaped as Y shaped fine hooks.

7. The device of claim 4, the blade further comprising a third pointed corner at the meeting of the first side edge and the second terminal edge.

8. The device of claim 4, wherein the second blade is removably attached to the second terminal edge, said second terminal edge including a second track portion to secure the second blade in place.

9. The device of claim 1, comprising a hole positioned in the body to aid storage of the device.

10. The device of claim 1, wherein the blade is removably attached to the first terminal edge, the first terminal edge terminating into a track portion around which a holding portion of the blade is configured to wrap around.

11. A device for removing lint, hair and pills from fabric comprising:

a body comprising: a first terminal edge, a second terminal edge, a side edge, a pointed corner, a first face and an opposing second face, each face bounded by the first terminal edge and the second terminal edge;

at least a first portion of the first face from the first terminal edge to a first distance inward on the first face being substantially parallel to at least a second portion of the second face from the first terminal edge to a second distance inward on the second face, and at least a third portion of the first face from the second terminal edge to a third distance inward on the first face being substantially parallel to at least a fourth portion of the second face from the second terminal edge to a fourth distance inward on the second face, wherein said body is made of stiff yet flexible material;

wherein the first portion and third portion extend along a same elevation of the first face, and wherein the second portion and fourth portion extend along a same elevation of the second face;

at least one blade comprising an outer surface of particle removing material, the blade being attached to the first face of the body from the first terminal edge to the first distance inward on the first face of the body and crossing to the second face of the body to the second distance inward on the second face of the body, such that the blade extends along a longitudinal length of the first terminal edge and the particle removing material covers the first terminal edge, the side edge and the pointed corner;

wherein brushing the blade across a surface of a fabric removes or brushes out unwanted lint, hair or pill balls.

12. The device of claim 11, wherein the particle removing material includes flexible finger-like projection made from a polymer.

13. The device of claim 11, wherein particle removing material includes evenly spaced Y shaped fine hooks.

14. The device of claim 11, wherein the device further comprises a second blade attached to the second terminal edge of the body.

15. The device of claim 14, wherein the second terminal edge of the body is parallel to the first terminal edge and the body comprises a plurality of pointed corners.

16. The device of claim 14, wherein the particle removing material of the at least one blade includes a plurality of evenly spaced projections and the second blade further comprises a surface of a plurality of particle removing projections of a same or a different grade or type as that of the at least one blade.

17. The device of claim 11, wherein the blade is removably attached to the first terminal edge at the first distance and the second distance inward on the body respectively, said first terminal edge including a track portion to hold the blade in place.

18. A device for removing lint, hair and pills from fabric comprising:

a body having a flat shape, a first side edge and a second side edge;

a first blade and a second blade, the first blade further comprising a first pointed corner at one terminal end of the first side edge and a second pointed corner at an opposite terminal end of the first side edge, the second blade further comprising a third pointed corner at one terminal end of the second side edge, and a fourth pointed corner at an opposite terminal end of the second side edge;

wherein the first blade is attached to and runs along a length of the first side edge, and the second blade is attached to and runs along a length of the second side edge, said first blade covered with particle removing projections such that contacting the first blade across a surface of the fabric removes or detangles unwanted lint, hair or pill balls.

19. The device of claim 18, wherein said first blade and second blade are covered with evenly spaced Y shaped particle removing projections such that contacting the second blade across the surface of the fabric removes or detangles unwanted lint, hair or pill balls.

20. The device of claim 19, wherein the body has a trapezoid shaped perimeter.

* * * * *